United States Patent [19]

Vitale

[11] Patent Number: 4,966,477

[45] Date of Patent: Oct. 30, 1990

[54] PAPER HOLDER FOR POSITIONING UNDERSIZED PAPER IN A TYPEWRITER

[76] Inventor: Sheila R. Vitale, 59-147B Piedmont Dr., Port Jefferson Station, N.Y. 11776

[21] Appl. No.: 77,726

[22] Filed: Jul. 27, 1987

[51] Int. Cl.[5] ..... B41J 13/12

[52] U.S. Cl. ..... 400/522; 400/622

[58] Field of Search ..... 400/522, 544, 521, 622, 400/531–535; 101/127.1; 40/10 R, 16, 124.2, 159

[56] References Cited

U.S. PATENT DOCUMENTS

| | | | |
|---|---|---|---|
| 1,225,073 | 5/1917 | Stafford et al. | 40/124.2 |
| 1,256,510 | 2/1918 | Belknap | 101/127.1 |
| 1,274,864 | 8/1918 | Evans | 101/127.1 |
| 1,462,497 | 7/1923 | Rand | 40/124.2 |
| 1,480,440 | 1/1924 | Hardman | 400/522 |
| 1,951,755 | 3/1934 | Hausman . | |
| 2,034,730 | 3/1936 | Palley | 400/522 |
| 2,239,354 | 4/1941 | Elliott | 101/127.1 |
| 2,539,718 | 1/1951 | Balzak | 400/522 |
| 2,758,695 | 8/1956 | Symonds | 400/544 X |
| 2,875,687 | 3/1959 | Renauer | 101/127.1 X |
| 4,118,120 | 10/1978 | Ruffner . | |
| 4,159,130 | 6/1979 | Larrabee | 400/522 X |
| 4,448,558 | 5/1984 | Weingarten . | |
| 4,598,903 | 7/1986 | Sarumaru | 400/622 X |
| 4,636,099 | 1/1987 | Goldstone . | |
| 4,790,475 | 12/1988 | Griffin | 400/522 X |
| 4,822,017 | 4/1989 | Griesmyer | 400/622 X |

FOREIGN PATENT DOCUMENTS

| | | | |
|---|---|---|---|
| 0039979 | 3/1982 | Japan | 400/522 |
| WO87/02973 | 5/1987 | PCT Int'l Appl. | 400/622 |
| 61442 | 7/1912 | Switzerland | 400/522 |

OTHER PUBLICATIONS

Cross et al., "Card Adapter for Continuous Form Printers", *IBM Tech Disc Bul*, vol. 14, No. 3, Aug. 1971, p. 899.

*Primary Examiner*—Clifford D. Crowder

*Attorney, Agent, or Firm*—Thomas J. Scott, Jr.

[57] ABSTRACT

A paper holding apparatus suitable for holding undersized paper products in a typewriter mechanism. The paper holder includes two flexible plastic strips mounted on a backing. The strips have opposed recesses in which the undersized paper product may be positioned. The holder is of sufficient size to operate normally in a typewriter mechanism. It may be reusable or disposable depending upon the application.

7 Claims, 2 Drawing Sheets

PAPER HOLDER FOR POSITIONING UNDERSIZED PAPER IN A TYPEWRITER

BACKGROUND OF INVENTION

1. Field of Invention

This invention relates to paper holding apparatus which holds undersized paper materials such as index cards, rolodex cards and the like in proper position against the platen of a typewriter mechanism to achieve proper alignment and guide during typing.

2. Description of the Prior Art

Typewriters are designed to print even, aligned characters on a paper positioned in the typewriter in a secure stationary position. Conventionally, standard size paper products are held against the typewriter platen by rollers positioned against the platen above and below the zone in which the hammer or ball strikes a ribbon against the paper and platen to print characters. The platen usually is a roller structure positioned in a cradle and permitted to rotate around its center axis. The roller is generally secured to the ends of the cradle. The lower portion of the cradle of a typewriter paper holding mechanism conventionally incorporates two separate rows of rollers which allow standard letter sized and larger paper to be loaded into the mechanism and held in position. A third row of rollers is mounted on a moveable arm positionable against the platen above the strike zone. Once the paper is loaded in typewriter, these upper rollers are positioned against the platen to hold the paper around the platen so that a printing or striking element can be positioned in front of a ribbon to print characters on the paper. The printing element can be moved with respect to the platen or, alternatively, the platen and cradle in a carriage can be moved with respect to a stationary striking element. In either case, the paper holding mechanism is designed only to load and hold conventional letter sized or larger paper.

This holding mechanism does not adequately function to grip undersized paper products such as index cards or rolodex cards. Because of the sizing of the typewriter holding mechanism, when undersized paper products are placed in the typewriter, the paper is inadequately gripped. Characters typed on such paper may be misaligned or keystrokes superimposed on each other. Undersized paper is generally difficult to position around the platen. Undersized paper is frequently ripped, torn or crushed when, in the case of a moving printing element, the printing element is returned to the opposite margin after typing a line and collides with the protruding upper edge of a card, only secured at its lower edge. The impact of this collision very commonly not only rips or tears the card but also removes the card's lower edge from the securing mechanism. Undersized paper may also become trapped in the cradle between the platen and the lower rollers. As a result, undersized paper may jam and become ripped when the user attempts to remove the product. Not infrequently, it is necessary to dismantle the typewriter by removing the platen from its cradle in order to retrieve a card which has completely jammed the securing mechanism, preventing the insertion of paper of any size into the typewriter.

Several prior art efforts have attempted to address this problem. U.S. Pat. No. 1,480,440 (Walter A. Hardman) discloses a card holder for typewriters. The Hardman patent discloses a flexible metal product on which flanges are crimped to provide grips for the upper and lower edge of an index card. A friction strip is positioned in either side of the cardholder to prevent injury to the flange holding mechanism. The Hardman device has numerous inadequacies and is expensive to produce because of the materials it incorporates. Crimping metal for the flange grip is an expensive manufacturing operation. The techniques required for affixing the friction strip to the flexible metal are too expensive for the production of normal office paper products. Additionally, when using Hardman's device, the operator positions the cardholder in the typewriter and then places the paper in the holder. This technique adds additional clerical time in the preparation of index cards.

U.S. Pat. No. 2,539,718 (Julius Balzak) discloses a paperholder for securing an index card or label in a typewriter. The Balzak patent discloses a paperholder made of pliable backing material such as oilcloth, plastic or similar material capable of being wound around the platen of a typewriter. Two slits are made in the backing material. A strip of flexible material is positioned in the slits. A seam or slot on the edge of the flexible strip secures the label or card. The Balzak device is deficient because it requires insertion of the paperholder in the typewriter prior to positioning the label in the holder. The Balzak holder allows the production of only one card at a time. Since the label is only secured at one end, the Balzak holder cannot insure that the paper will not be accidentally shifted or moved by the operator. Also, the Balzak holder provides no means for holding the lower end of the paper against the platen so that the label is properly positioned and aligned against the platen for typing. Since the Balzak holder so inadequately secures the paper, jamming of the paper in the typewriter when it is introduced by the operator is highly likely.

SUMMARY OF INVENTION

The object of the present invention is to provide an inexpensive mechanism for securing undersized paper products in a typewriter to overcome the inadequacies of the prior art. A further object of the present invention is to provide a method and apparatus to efficiently and safely load and unload undersized paper products in a typewriter. Another object of the invention is to provide a method and apparatus to adequately secure undersized paper against a typewriter platen so that accurate properly aligned inscription can be made on the paper by the typewriter hammer or strike mechanism. The present invention consists of a paper or plastic base on which pliable strips are adhered at appropriate points on the opposed margins. The outside portion of the pliable strips are entirely adhered to the base at the margin. In the interior portion of the strips, recesses between the strip and the base are provided so that undersized paper products can be rigidly mounted between the plastic strips in the opposed margins. The invention envisions that the cards and backing will be provided as a unit so that a group of cards may be conveniently typed at once by merely placing the backing sheet with cards in the typewriter and making the necessary inscriptions.

DETAILED DESCRIPTION OF PREFERRED EMBODIMENT

The paperholder of this invention has a plastic or paper base or backing 1. The base or backing is of sufficient size so that it may be positioned conventionally in the securing mechanism of a typewriter and held against the platen by the conventional paper holding mechanism of the typewriter. Index or rolodex cards A, B and C are held on the backing by flexible or pliable strips described below. The upper and lower margins of the backing are sufficient to permit the conventional roller holding mechanism of a typewriter cradle and platen to hold the holder apparatus with adequate firmness so that the cards may be fully inscribed. Usually the paperholder base will be greater than six inches by eight inches.

Figure 1:
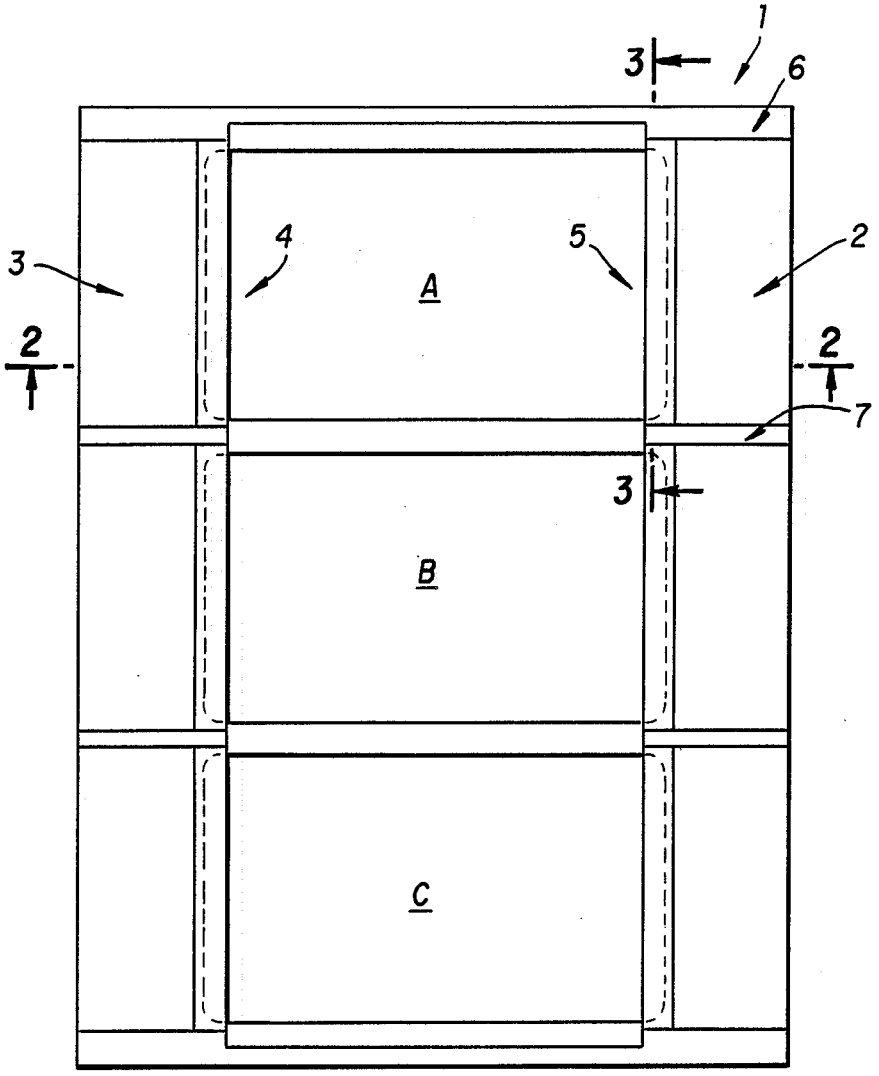
FIG. 1 is a front plan view of the paperholder of this invention.
Figure 2:
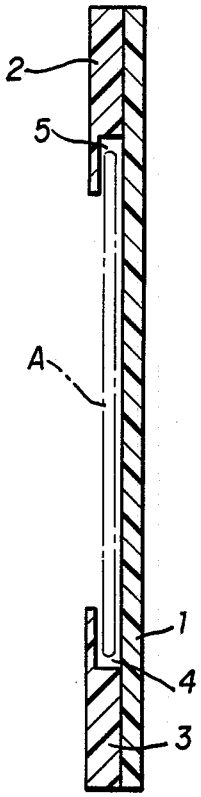
FIG. 2 is a sectional view of the paperholder taken along lines 2—2 of FIG. 1.
Figure 3:
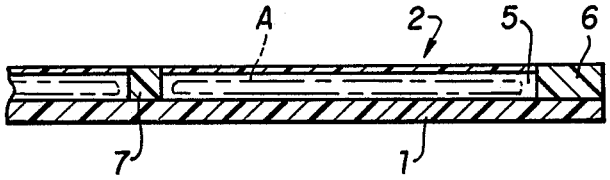
FIG. 3 is a sectional view of the paperholder taken along lines 3—3 of FIG. 1.

On the right and left margins of the paperholder, plastic strips 2 and 3 are adhered to the base at its outside edges by a conventional adhesive used in paper products. Cross members 6 and 7 as shown in FIGS. 1 and 3 are positioned between adjacent flexible strips on each outside margin of the flexible backing. The strips 2 and 3 are provided with recesses 4 and 5. The recesses are positioned in the strips between their lower surface, and the upper surface of the backing so that an undersized paper product such as an index card or rolodex card may be slipped into the recess. The recesses are formed as cavities between the flexible strips and the base or backing. Each recess is defined by (a) the upper surface of the backing and lower surface of the flexible strip, (b) a boundary formed by the junction of the flexible strip and the base or backing 1 and (c) upper and lower boundaries formed by cross members 6 and 7 shown in FIGS. 1 and 3. The three boundaries of each recess act in conjunction with the upper and lower surfaces to hold the undersized paper product firmly in position. The recesses in the opposed margins are aligned so that the undersized paper is held rigidly against the backing or base 1. The backing may be provided with cards inserted or, alternatively, the holder alone may be provided and the purchaser may insert his own cards.

Undersized product A is positioned between the plastic strips and held rigidly in the recess. The backing is inserted in the typewriter and conventional typing techniques are used to apply inscriptions on the cards. Conventionally, the paperholder will include more than one card, usually two to six, so that several cards can be prepared in one operation. If the holder is supplied with cards enclosed, it may be reusable since the recesses are such a size that the operator may insert additional cards once the rolodex or indexcards have been typed and removed. However, the product is designed to be so inexpensive to manufacture that it may be used as a "throw away" product. Thus, the backing may be discarded after the attached cards have been prepared. The present invention provides the convenience and speed so highly desirable in today's fast paced business world.

While a preferred embodiment of the card holder has been herein described, those skilled in the art will recognize various alternative designs and embodiments for practicing the present invention as defined by the following claims:

What is claimed is:

1. A paperholder for undersized paper products comprising:
   - a flexible backing sheet having opposed margins and sized to be securely positionable in a conventional typewriter mechanism;
   - a flexible strip adhered to each opposed margin of said backing sheet and forming a recess with said backing sheet;
   - said flexible strip and said flexible backing sheet defining upper and lower surfaces for said recess;
   - an outer boundary for said recess being formed where said flexible strip joins said backing sheet;
   - cross members also mounted on said backing sheet for defining upper and lower boundaries for said recess and said recess being aligned to an opposing recess in said flexible strip on the opposed margin of said flexible backing sheet so that an undersized paper product may be positioned therein and held in firm alignment to said flexible backing sheet.

2. A paperholder as claimed in claim 1 wherein the flexible backing sheet is made of paper.

3. A paperholder as claimed in claim 1 wherein the flexible strip is made of paper.

4. A paperholder as claimed in claim 1 wherein the flexible backing sheet is made of plastic.

5. A paperholder as claimed in claim 1 wherein the flexible strip is made of plastic.

6. A disposable paperholder for undersized paper products comprising:
   - a flexible backing sheet having opposed margins and sized to be securely positionable in a conventional typewriter mechanism;
   - flexible strips adhered to each opposed margin of said backing sheet and forming at least two recesses with said backing sheet at each opposed margin;
   - said flexible strip and said flexible backing sheet defining upper and lower surfaces for said recess;
   - an outer boundary for each said recess being formed where said flexible strip joins said backing sheet;
   - cross members also mounted on said backing sheet for defining upper and lower boundaries for each said recess;
   - each said recess being aligned to an opposing recess in said flexible strip on the opposed margin of said flexible backing sheet so that an undersized paper product may be positioned therein and held in firm alignment to said backing sheet; and
   - undersized paper products positioned in said opposed recesses.

7. A disposable paperholder for undersized paper products comprising:
   - a flexible backing sheet having opposed margins and sized to be securely positionable in a conventional typewriter mechanism;
   - a flexible strip adhered to each opposed margin of said backing sheet and forming a recess with said backing sheet;
   - said flexible strip and said flexible backing sheet defining upper and lower surfaces for said recess;
   - an outer boundary for said recess being formed where said flexible strips joins said backing sheet;
   - cross members also mounted on said backing sheet for defining upper and lower boundaries for said recess; and
   - each said recess being aligned to an opposing recess in said flexible strip on the opposed margin of said flexible backing sheet so that an undersized paper product may be positioned therein and held firm in alignment to said backing sheet.

* * * * *